US008529754B2

(12) United States Patent
Cui et al.

(10) Patent No.: US 8,529,754 B2
(45) Date of Patent: Sep. 10, 2013

(54) CATALYTIC CONVERSION PROCESS FOR PRODUCING MORE DIESEL AND PROPYLENE

(75) Inventors: Shouye Cui, Beijing (CN); Youhao Xu, Beijing (CN); Zhihai Hu, Beijing (CN); Jianhong Gong, Beijing (CN); Chaogang Xie, Beijing (CN); Yun Chen, Beijing (CN); Zhigang Zhang, Beijing (CN); Jianwei Dong, Beijing (CN)

(73) Assignees: China Petroleum & Chemical Corporation, Beijing (CN); Research Institute of Petroleum Processing, Singopec, Beijing (CN)

( * ) Notice: Subject to any disclaimer, the term of this patent is extended or adjusted under 35 U.S.C. 154(b) by 383 days.

(21) Appl. No.: 12/888,780

(22) Filed: Sep. 23, 2010

(65) Prior Publication Data

US 2011/0073523 A1 Mar. 31, 2011

(30) Foreign Application Priority Data

| | | |
|---|---|---|
| Sep. 28, 2009 | (CN) | 2009 1 0177173 |
| Sep. 28, 2009 | (CN) | 2009 1 0177174 |
| Oct. 27, 2009 | (CN) | 2009 1 0180371 |
| Oct. 27, 2009 | (CN) | 2009 1 0180372 |

(51) Int. Cl.
*C10G 11/00* (2006.01)

(52) U.S. Cl.
USPC ..... 208/113; 208/120.1; 208/122; 502/65; 502/67

(58) Field of Classification Search
USPC ..... 208/69; 502/20, 65
See application file for complete search history.

(56) References Cited

U.S. PATENT DOCUMENTS

| | | | | |
|---|---|---|---|---|
| 4,422,925 | A | 12/1983 | Williams et al. | |
| 2010/0213102 | A1* | 8/2010 | Xu et al. | 208/69 |
| 2011/0000818 | A1* | 1/2011 | Xu et al. | 208/70 |

FOREIGN PATENT DOCUMENTS

| | | | |
|---|---|---|---|
| CN | 1279270 | A | 1/2001 |
| CN | 1289832 | A | 4/2001 |
| CN | 1900226 | A | 1/2007 |
| CN | 101314724 | A | 12/2008 |
| CN | 101531923 | A | 9/2009 |
| CN | 101760227 | A | 6/2010 |

(Continued)

OTHER PUBLICATIONS

Great Britain Search Report dated Jan. 26, 2011 issued in corresponding Application No. GB1016294.9.

(Continued)

*Primary Examiner* — Randy Boyer
*Assistant Examiner* — Juan Valencia
(74) *Attorney, Agent, or Firm* — Scully, Scott, Murphy & Presser. P.C.

(57) ABSTRACT

The present invention relates to a catalytic conversion process for producing more diesel and propylene, comprising contacting the feedstock oil with a catalyst having a relatively homogeneous activity in a reactor, wherein the reaction temperature, weight hourly space velocity and weight ratio of the catalyst/feedstock oil are sufficient to obtain a reaction product containing from 12 to 60% by weight of a fluid catalytic cracking gas oil relative to the weight of the feedstock oil; the fluid catalytic cracking gas oil is fed into the fluid catalytic cracking gas oil treatment device for further processing. Catalytic cracking, hydrogenation, solvent extraction, hydrocracking and process for producing more diesel are organically combined together, and hydrocarbons such as alkanes, alkyl side chains in the feedstock for catalysis are selectively cracked and isomerized.

54 Claims, 1 Drawing Sheet

(56) References Cited

FOREIGN PATENT DOCUMENTS

| | | | | |
|---|---|---|---|---|
| EP | 2 184 335 | A1 | | 5/2010 |
| WO | 2006/124175 | A3 | | 11/2006 |
| WO | WO/2009/018722 | | * | 2/2009 |
| WO | 2009/111953 | A1 | | 9/2009 |
| WO | WO/2009/111953 | | * | 9/2009 |

OTHER PUBLICATIONS

Cuiding, Y. et al., "Micro-reaction test Method for Catalytic Cracking Fresh Catalysts" *Petrochemical Analytic Method* (*RIPP Test Method*), Enterprise Standard RIPP 92-90 (1990), together with English-language abstract and partial English translation.

Examination Report dated Feb. 15, 2013 issued in corresponding British Application No. GB1016294.9.

* cited by examiner

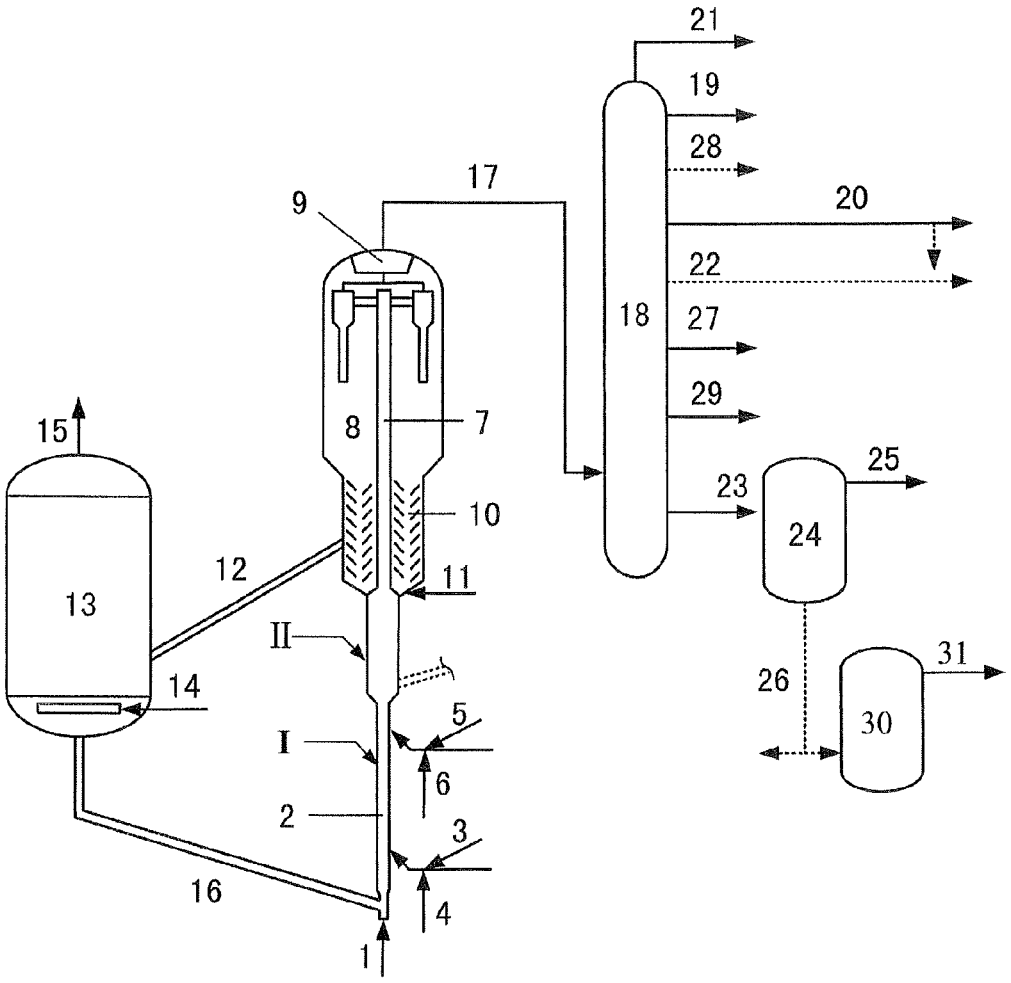
21
19
28
17
9
20
22
18
27
29
15
8
7
25
23
10
24
12
11
13
II
31
26
14
5
30
I
6
2
3
16
4
1

CATALYTIC CONVERSION PROCESS FOR PRODUCING MORE DIESEL AND PROPYLENE

FIELD OF THE INVENTION

The present invention relates to a process for the catalytic conversion of hydrocarbon oil in the absence of hydrogen. Specifically, the present invention relates to a catalytic conversion process for converting heavy feedstocks into high cetane number diesel and propylene.

BACKGROUND OF THE INVENTION

Currently, global demands for high quality gasoline are increasingly stepped up. Technologies of producing more high quality gasoline are rapidly developed, but the development of technologies of producing high cetane number diesel is relatively slow. On the whole, the growth speed of the global demands for diesel will gradually go beyond that on gasoline, although the area demands vary. Diesel produced by the conventional catalytic cracking technology has a relatively lower cetane number, so that it is usually used as the harmonic component of diesel. In order to satisfy the demands for high quality diesel, it is necessary to modify the catalytic light diesel.

In the prior art, the processes for modifying the catalytic light diesel primarily include hydrogenation and alkylation. CN1289832A also discloses a process for modifying the catalytically cracked diesel, comprising, under the hydrogenation conditions, passing the feedstocks in turn through the hydrorefining catalyst and the hydrocracking catalyst in single-stage series without any intermediate separation. Due to said process, the cetane number of the diesel fraction in the product is increased by 10 units as compared with the feedstocks, and the sulfur content and nitrogen content are notably decreased.

CN1900226A discloses a catalytic cracking promoter for producing more diesel and a process for preparing the same. By the addition of a certain amount of such promoter, the diesel yield of FCC catalytic unit will be increased, and the product distribution will be improved without any change of the catalyst initially used in the refining unit. However, such process does not mention any improvement in the properties of diesel.

Low-carbon olefins, such as propylene and the like, are the important organic chemical materials, and propylene is the synthetic monomer for the products such as polypropylene, acrylonitrile and the like. With the rapid increase of the demands for the derivatives such as polypropylene, the demand for propylene is also increased annually. The global propylene demand has been increased from 15,200,000 tons twenty years ago to 51,200,000 tons in 2000, and the annual rate of increase is 6.3%. It is predicted that the propylene demand in 2010 will reach to 86,000,000 tons, and the annual rate of increase is about 5.6%.

The methods for producing propylene are primarily steam cracking and fluid catalytic cracking (FCC). Steam cracking involves thermally cracking light oils as the feedstocks, such as naphtha and the like, to produce ethylene and propylene, but the propylene yield is only about 15 wt %. FCC involves using as the feedstocks heavy oils vacuum gas oil (VGO). At present, 61% of propylene in the world is derived from the by-products obtained by producing ethylene via steam cracking; 34% is derived from the by-products obtained by producing gasoline and diesel via FCC in the oil refinery; and a small amount (about 5%) of propylene are obtained by propane dehydrogenation and ethylene-butylene metathesis reaction.

If the conventional routes for producing ethylene and propylene by steam cracking are still utilized, the petrochemical industry will be limited by several main restricting factors such as lack of light feedstock oils, undercapacity and unduly high cost.

Due to the advantages such as high adaptability and flexible operation of the feedstocks, more attentions are focused on FCC. In U.S.A, almost one half of the demand in the propylene market is derived from FCC unit. Technologies for improving the catalytic cracking for increasing the production of propylene are rapidly developing.

U.S. Pat. No. 4,422,925 discloses a process for contacting many hydrocarbons having different cracking properties with a hot regenerated catalyst and converting, wherein the hydrocarbons at least comprise a gas alkane feedstock and a liquid hydrocarbon feedstock. On the basis that different hydrocarbon molecules have different cracking properties, the reaction zone in the process is divided into many reaction zones for cracking, so as to produce more low molecule olefins.

CN1279270A discloses a catalytic conversion process for producing more diesel and liquefied gas, wherein the process is conducted in a four-stage riser or a fluidized bed reactor; the gasoline feedstocks, conventional cracking feedstocks and reaction terminating agent are fed into different positions. Said process can simultaneously increase the yields of liquefied gas and diesel, but it has relatively higher dry gas and coke yields.

For a long time, those ordinarily skilled in the art are of the opinion that, the higher the conversion ratio of the heavy oil catalytic cracking is, the better. Upon creative thinking and repeated experiments, the applicant finds that, it is not "the higher, the better" in the conversion ratio of the heavy oil catalytic cracking. When the conversion ratio reaches to a certain extent, the target product increases a little, while the dry gas and coke yields greatly increase. In the conventional catalytic cracking catalyst, the particles having a particle size of less than 40 μm are in an amount of about 20% by volume. Upon studies, it can be found that, although the small catalyst particles have higher cracking capability, the selectivity thereof to dry gas and coke is relatively worse. The optimization of the size distribution of the catalyst may improve the selectivity of dry gas and coke.

In order to efficiently utilize inferior heavy oil resources and satisfy the increasing demands for light fuel oils, it is necessary to develop a catalytic conversion process for converting heavy feedstocks into clean diesel and propylene in a great amount.

SUMMARY OF THE INVENTION

The object of the present invention is to provide a process for converting heavy oils to high cetane number diesel and propylene on the basis of the prior art. The present invention primarily involves selectively cracking and isomerizing hydrocarbons in the catalytic feedstocks, such as alkanes, alkyl side chains and the like, minimizing at the same time the entry of aromatic hydrocarbons in the feedstocks into the diesel fractions, avoiding other components in the product from retention in the diesel fractions by producing aromatic hydrocarbons via aromatization and the like. While the feedstocks are cracked into high cetane number diesel and propylene, the dry gas and coke yields are significantly reduced, so as to achieve the efficient utilization of petroleum resources.

In one aspect of the present invention, the present invention provides a catalytic conversion process, characterized in contacting the feedstock oil with a catalytic cracking catalyst, preferably a catalytic cracking catalyst having a relatively homogeneous activity, in a catalytic cracking reactor, wherein the reaction temperature, weight hourly space velocity and weight ratio of the catalyst/feedstock oil are sufficient to obtain a reaction product containing from 12 to 60%, preferably from 20 to 50% by weight of a fluid catalytic cracking gas oil relative to the weight of the feedstock oil; the weight hourly space velocity is from 25 to 100 $h^{-1}$; the reaction temperature ranges from 450 to 600° C.; the weight ratio of the catalytic cracking catalyst/feedstock oil is 1-30; and the fluid catalytic cracking gas oil is fed into at least one of a hydrogenation device, a solvent extraction device and a hydrocracking device for further processing.

In a more preferred embodiment, the hydrogenated fluid catalytic cracking gas oil or/and the fluid catalytic cracking gas oil raffinate obtained by the solvent extraction or/and the hydrocracked tail oil obtained by hydrocracking the fluid catalytic cracking gas oil is/are used as the feedstocks for one or more unit selected from the group consisting of an unit for producing more diesel, the present reactor, a hydrocracking unit, a steam cracking unit, and other reactors, preferably as the feedstocks for the unit for producing more diesel. In a more preferred embodiment, the unit for producing more diesels is a catalytic cracking unit. In a more preferred embodiment, the catalyst used in the catalytic cracking unit for producing more diesel is the catalyst for producing more diesel, wherein the catalyst has a relatively homogeneous activity.

In a more preferred embodiment, the reaction temperature preferably ranges from 460 to 580° C., more preferably ranges from 480 to 540° C.

In a more preferred embodiment, the weight hourly space velocity ranges from 30 to 80 $h^{-1}$, preferably from 40 to 60 $h^{-1}$.

In a more preferred embodiment, the catalyst/feedstock oil weight ratio is preferably from 2 to 25, more preferably from 2 to 15, most preferably from 3 to 14.

The water vapor/cracking feedstock oil weight oil ranges from 0.05 to 1.0.

In a more preferred embodiment, the reaction pressure ranges from 0.10 to 1.0 MPa.

In a more preferred embodiment, the feedstock oil is selected from or comprises petroleum hydrocarbons and/or other mineral oils, wherein petroleum hydrocarbons are selected from the group consisting of vacuum gas oil, atmospheric gas oil, coker gas oil, deasphalted oil, vacuum residue and atmospheric residue or combinations of two or more; other mineral oils are selected from the group consisting of coal liquefied oil, oil sand oil and shale oil, or combinations of two or more.

In a more preferred embodiment, the catalytic cracking catalyst comprises zeolites, inorganic oxides and optionally clays respectively in an amount of from 1 to 50 wt %, from 5 to 99 wt %, and from 0 to 70 wt % relative to the total weight of the catalyst, wherein the zeolites are medium pore zeolites and optionally large pore zeolites respectively in an amount of from 51 to 100 wt % (preferably from 70 to 100 wt %) and from 0 to 49 wt % (preferably from 0 to 30 wt %) relative to the total weight of the zeolites; the medium pore zeolites are selected from the group consisting of ZSM-series zeolites and/or ZRP zeolites; and the large pore zeolites are selected from the group consisting of Y-series zeolites.

The catalyst having a relatively homogeneous activity (including the catalytic cracking catalyst used in the catalytic cracking reactor and the catalyst for producing more diesel used in the unit for producing more diesel) has an initial activity of not higher than 80, preferably not higher than 75, more preferably not higher than 70, a self-balancing time ranging from 0.1 to 50 h, preferably from 0.2 to 30 h, more preferably from 0.5 to 10 h, and an equilibrium activity ranging from 35 to 60, preferably from 40 to 55.

The initial activity of the catalyst or the fresh catalyst activity as mentioned below means the catalyst activity evaluated by the light oil micro-reaction unit. It can be measured by the measuring method in the prior art: Enterprise standard RIPP 92-90—Micro-reaction test method for catalytic cracking fresh catalysts, *Petrochemical analytic method* (*RIPP test method*), Yang Cuiding et al, 1990 (hereinafter referred to as RIPP 92-90). The initial activity of the catalyst is represented by light oil micro-reaction activity (MA), calculated by the formula MA=(output of the gasoline having a temperature less than 204° C. in the product+gas output+coke output)/total weight of the feedstock oil*100%=the yield of the gasoline having a temperature less than 204° C. in the product+gas yield+coke yield. The evaluation conditions of the light oil micro-reaction unit (referring to RIPP 92-90) include pulverizing the catalyst into particles having a particle diameter of 420-841 μm; the weight being 5 g; the reaction feedstocks being straightrun light diesel fuel having a distillation range of 235-337° C.; the reaction temperature being 460° C.; the weight hourly space velocity being 16 $h^{-1}$; and the catalyst/oil ratio being 3.2.

The self-balancing time of the catalyst is the time necessary for achieving the equilibrium activity by ageing at 800° C. and 100% water vapor (by reference to RIPP 92-90).

The catalyst having a relatively homogeneous activity is obtainable by, for example, the following three processing methods.

The catalyst-processing method 1:

(1) feeding a fresh catalyst into the fluidized bed, preferably a dense phase fluidized bed, contacting with water vapor, ageing under a certain hydrothermal circumstance to obtain a catalyst having a relatively homogeneous activity; and (2) feeding the catalyst having a relatively homogeneous activity into the corresponding reaction unit.

The processing method 1 is specifically carried out, for example, as follows.

A fresh catalyst is fed into a fluidized bed, preferably a dense phase fluidized bed, and water vapor is fed into the bottom of the fluidized bed. The fluidization of the catalyst is achieved under the action of water vapor, and the catalyst is aged by water vapor at the same time to obtain the catalyst having a relatively homogeneous activity. The ageing temperature ranges from 400° C. to 850° C., preferably from 500° C. to 750° C., more preferably from 600° C. to 700° C. The superficial linear velocity of the fluidized bed ranges from 0.1 to 0.6 m/s, preferably from 0.15 to 0.5 m/s. The ageing time ranges from 1 to 720 h, preferably from 5 to 360 h. According to the requirements on the industrial unit, the catalyst having a relatively homogeneous activity is added into the industrial unit, preferably into the regenerator of the industrial unit.

The catalyst-processing method 2:

(1) feeding a fresh catalyst into the fluidized bed, preferably a dense phase fluidized bed, contacting with an ageing medium containing water vapor, ageing under a certain hydrothermal circumstance to obtain a catalyst having a relatively homogeneous activity; and (2) feeding the catalyst having a relatively homogeneous activity into the corresponding reaction unit.

The technical solution of the catalyst-processing method 2 is specifically carried out, for example, as follows.

A fresh catalyst is fed into a fluidized bed, preferably a dense phase fluidized bed, and an ageing medium containing water vapor is fed into the bottom of the fluidized bed. The fluidization of the catalyst is achieved under the action of the ageing medium containing water vapor, and the catalyst is aged by the ageing medium containing water vapor at the same time to obtain the catalyst having a relatively homogeneous activity. The ageing temperature ranges from 400° C. to 850° C., preferably from 500° C. to 750° C., more preferably from 600° C. to 700° C. The superficial linear velocity of the fluidized bed ranges from 0.1 to 0.6 m/s, preferably from 0.15 to 0.5 m/s. The weight ratio of water vapor to the ageing medium ranges from 0.20 to 0.9, preferably from 0.40 to 0.60. The ageing time ranges from 1 to 720 h, preferably from 5 to 360 h. According to the requirements on the industrial unit, the catalyst having a relatively homogeneous activity is added into the industrial unit, preferably into the regenerator of the industrial unit. The ageing medium comprises air, dry gas, regenerated flue gas, gas obtained by combusting air and dry gas or gas obtained by combusting air and burning oil, or other gases such as nitrogen gas. The weight ratio of water vapor and ageing medium ranges from 0.2 to 0.9, preferably from 0.40 to 0.60.

The catalyst-processing method 3:

(1) feeding a fresh catalyst into a fluidized bed, preferably a dense phase fluidized bed, feeding the hot regenerated catalyst in the regenerator into the fluidized bed, and heat exchanging the fresh catalyst and the hot regenerated catalyst in the fluidized bed;

(2) contacting the heat exchanged fresh catalyst with water vapor or the ageing medium containing water vapor, ageing under a certain hydrothermal circumstance to obtain a catalyst having a relatively homogeneous activity; and (3) feeding the catalyst having a relatively homogeneous activity into the corresponding reaction unit.

The technical solution of the present invention is specifically carried out, for example, as follows.

A fresh catalyst is fed into a fluidized bed, preferably a dense phase fluidized bed, and the hot regenerated catalyst in the regenerator is fed into the fluidized bed at the same time to heat exchange in the fluidized bed. Water vapor or an ageing medium containing water vapor is fed into the bottom of the fluidized bed. The fluidization of the fresh catalyst is achieved under the action of water vapor or the ageing medium containing water vapor, and the fresh catalyst is aged by water vapor or the ageing medium containing water vapor at the same time to obtain the catalyst having a relatively homogeneous activity. The ageing temperature ranges from 400° C. to 850° C., preferably from 500° C. to 750° C., more preferably from 600° C. to 700° C. The superficial linear velocity of the fluidized bed ranges from 0.1 to 0.6 m/s, preferably from 0.15 to 0.5 m/s. The ageing time ranges from 1 to 720 h, preferably from 5 to 360 h. Under the circumstance of the ageing medium containing water vapor, the weight ratio of water vapor to the ageing medium is greater than 0-4, preferably ranges from 0.5 to 1.5. According to the requirements on the industrial unit, the catalyst having a relatively homogeneous activity is added into the industrial unit, preferably into the regenerator of the industrial unit. In addition, water vapor after the ageing step is fed into the reaction system (as one or more selected from the group consisting of stripping steam, anticoking steam, atomizing steam and lifting steam, and respectively added into the stripper, settler, feedstock nozzle and prelifting zone of the catalytic cracking unit) or the regeneration system. The ageing medium containing water vapor after the ageing step is fed into the regeneration system, and the heat exchanged regenerated catalyst is recycled back to the regenerator. The ageing medium comprises air, dry gas, regenerated flue gas, gas obtained by combusting air and dry gas or gas obtained by combusting air and burning oil, or other gases such as nitrogen gas.

By the aforesaid processing methods, the activity and selectivity distribution of the catalyst in the industrial reaction unit are more homogeneous; the selectivity of the catalyst is notably improved so as to obviously decrease the dry gas and coke yields.

The particle size distribution of the catalyst (including the catalytic cracking catalyst and the catalyst for producing more diesel) may be the particle size distribution of the conventional catalyst or the coarse (big) particle size distribution. In a more preferred embodiment, the catalyst is characterized in using the catalyst having a coarse particle size distribution.

The catalytic cracking catalyst having a coarse particle size distribution comprise less than 10 vol. %, preferably less than 5 vol. % of the particles of the catalytic cracking catalyst having a particle size of less than 40 μm relative to the volume of all the particles of the catalytic cracking catalyst, less than 15 vol. %, preferably less than 10 vol. % of the particles of the catalytic cracking catalyst having a particle size of greater than 80 μm relative to the volume of all the particles of the catalytic cracking catalyst, and the remaining being the particles of the catalytic cracking catalyst having a particle size of from 40 to 80 μm.

The particle size distribution of the catalyst for producing more diesel in the unit for producing more diesel is preferably a coarse particle size distribution. The screening composition of the catalyst comprises less than 10 vol. %, preferably less than 5 vol. % of the particles of the catalyst for producing more diesel having a particle size of less than 40 μm relative to the volume of all the particles of the catalyst for producing more diesel, less than 15 vol. %, preferably less than 10 vol. % of the particles of the catalyst for producing more diesel having a particle size of greater than 80 μm relative to the volume of all the particles of the catalyst for producing more diesel, and the remaining being the particles of the catalyst for producing more diesel having a particle size of from 40 to 80 μm.

In a more preferred embodiment, the catalytic cracking reactor is selected from the group consisting of a riser, a fluidized bed with an equal linear velocity, a fluidized bed with an equal diameter, an upstream conveyor line and a downstream conveyor line or combinations of two or more, or combinations of two or more same reactors, wherein the combinations comprises combinations in series or/and parallel; the riser is a conventional one with an equal diameter or one with various variable diameters.

In a more preferred embodiment, the feedstock oil is fed into the catalytic cracking reactor at one position, or at two or more positions at the same or different heights.

In a more preferred embodiment, the process further comprises separating the catalytic cracking reaction product from the catalytic cracking catalyst, stripping and coke-burning the separated catalytic cracking catalyst and recycling to the catalytic cracking reactor, wherein the separated product comprises propylene, diesel and fluid catalytic cracking gas oil.

In a more preferred embodiment, the fluid catalytic cracking gas oil is a fraction having an initial boiling point of not less than 260° C. and a hydrogen content of not less than 10.5 wt %.

In a more preferred embodiment, the fluid catalytic cracking gas oil is a fraction having an initial boiling point of not less than 330° C. and a hydrogen content of not less than 10.8 wt %.

The hydrogenating reaction system is usually a fixed bed reactor, and the hydrogenating catalyst is a non-noble Group VIB or/and Group VIII metal catalyst supported on the amorphous alumina or/and silicon-aluminium carrier, wherein the non-noble Group VIB metal is molybdenum or/and tungsten; and the non-noble Group VIII metal is one or more selected from nickel, cobalt and iron.

The hydrogenation is conducted under the processing conditions of a hydrogen partial pressure of from 4.0 to 20.0 MPa, a reaction temperature of from 280 to 450° C., a volume hourly space velocity of 0.1 to 20 $h^{-1}$, and a hydrogen/oil ratio of from 300 to 2000 v/v.

The current aromatic hydrocarbon extraction unit is applicable for the aromatic hydrocarbon extraction unit in the process. The solvent for the aromatic hydrocarbon extraction is one or more selected from the group consisting of furfural, dimethylsulfoxide, dimethyl formamide, monoethanolamine, ethylene glycol, and 1,2-propylene glycol. The solvent is recoverable; the extraction is conducted at a temperature of from 40 to 120° C.; and the solvent/fluid catalytic cracking gas oil volume ratios ranges from 0.5:1 to 5.0:1.

The hydrocracking reaction system usually comprises a refining reactor and a cracking reactor, which both are the fixed bed reactors. The refining reactor is usually filled with a hydrogenating catalyst. The hydrogenating catalyst is a non-noble Group VIB or/and Group VIII metal catalyst supported on the amorphous alumina or/and silicon-aluminium carrier, and the hydrocracking catalyst is a non-noble Group VIB or/and Group VIII metal catalyst supported on the Y-type zeolite molecular sieves, wherein the non-noble Group VIB metal is molybdenum or/and tungsten; and the non-noble Group VIII metal is one or more selected from nickel, cobalt and iron.

The hydrocracking is conducted under the processing conditions of a hydrogen partial pressure of from 4.0 to 20.0 MPa, a reaction temperature of from 280 to 450° C., a volume hourly space velocity of 0.1 to 20 $h^{-1}$, and a hydrogen/oil ratio of from 300 to 2000 v/v.

In a more preferred embodiment, the unit for producing more diesel has a reaction temperature ranging from 400 to 650° C., preferably from 430 to 500° C., more preferably from 430 to 480° C., an oil and gas residence time of from 0.05 to 5 seconds, preferably from 0.1 to 4 seconds and a reaction pressure of from 0.10 to 1.0 MPa.

In a more preferred embodiment, the catalyst for producing more diesel comprises zeolites, inorganic oxides and clays respectively in an amount of, based on the dry basis, from 5 to 60 wt % (preferably from 10 to 30 wt %); from 0.5 to 50 wt %; and from 0 to 70 wt % relative to the total weight of the catalyst, wherein the zeolites as the active ingredients are selected from large pore zeolites which are selected from the group consisting of rare earth Y, hydrogen rare earth Y, ultrastable Y obtained by various methods and high-silicon Y, or combinations of two or more.

The inorganic oxide as the substrate is selected from the group consisting of $SiO_2$ and/or $Al_2O_3$. On the basis of dry basis, $SiO_2$ ranges from 50 to 90 wt %, and $Al_2O_3$ ranges from 10 to 50 wt % relative to the weight of the inorganic oxide.

The clay as the binder is one or more selected from the group consisting of kaolin, meta halloysite, montmorillonite, diatomite, halloysite, saponite, rectorite, sepiolite, attapulgite, hydrotalcite, and bentonite.

In a more preferred embodiment, the reactor for producing more diesel is selected from the group consisting of a riser, a fluidized bed with an equal linear velocity, a fluidized bed with an equal diameter, an upstream conveyor line and a downstream conveyor line or combinations of two or more, or combinations of two or more same reactors, wherein the combinations comprises combinations in series or/and parallel; the riser is a conventional one with an equal diameter or one with various variable diameters.

In a more preferred embodiment, the hydrogenated fluid catalytic cracking gas oil or/and the fluid catalytic cracking gas oil raffinate obtained by the solvent extraction or/and the hydrocracked tail oil obtained by hydrocracking the fluid catalytic cracking gas oil is/are fed into the reactor for producing more diesel at one position, or the hydrogenated fluid catalytic cracking gas oil is fed into the reactor for producing more diesel at two or more positions at the same or different heights.

In a more preferred embodiment, the process for producing more diesel further comprises separating the reaction product in the reactor for producing more diesel from the catalyst for producing more diesel, stripping and coke-burning the separated catalyst for producing more diesel and recycling to the reactor for producing more diesel, wherein the separated product comprises high cetane number diesel and propylene.

In another aspect of the present invention, the present invention provides catalytic conversion process for producing more diesel and propylene, characterized in contacting the feedstock oil with a catalytic cracking catalyst, preferably a catalytic cracking catalyst having a relatively homogeneous activity, in a catalytic cracking reactor, further comprising (1) introducing the feedstock oil comprising the re-cracked feedstock oil and the cracking feedstock oil into a catalytic cracking reactor at one position, at two or more positions at the same or different heights;
(2) reacting the re-cracked feedstock oil in the catalytic cracking reactor at a time not later than the reaction of the cracking feedstock oil;
(3) the reaction temperature, weight hourly space velocity and weight ratio of the catalyst/feedstock oil in said catalytic cracking reaction being sufficient to obtain a reaction product containing from 12 to 60% by weight of a fluid catalytic cracking gas oil relative to the weight of the cracking feedstock oil, wherein the weight hourly space velocity of the cracking feedstock oil is from 5 to 100 $h^{-1}$;
(4) the fluid catalytic cracking gas oil being fed into the hydrogenation or/and solvent extracting unit and/or hydrocracking unit for further processing; and
(5) the hydrogenated fluid catalytic cracking gas oil obtained by hydrogenating the fluid catalytic cracking gas oil or/and the fluid catalytic cracking gas oil raffinate obtained by the solvent extraction or/and the hydrocracked tail oil obtained by hydrocracking being used as the feedstock oil for the unit for producing more diesel.

In a more preferred embodiment, the unit for producing more diesel is the catalytic cracking unit for producing more diesel. In a more preferred embodiment, the catalyst used in the catalytic cracking unit for producing more diesel is the catalyst for producing more diesel, wherein the catalyst has a relatively homogeneous activity.

In a more preferred embodiment, the re-cracked feedstock oil is selected from the group consisting of or comprises one selected from the group consisting of oil slurry, diesel, gasoline, hydrocarbons having a carbon atom number of from 4 to 8, or combinations of two or more.

In a more preferred embodiment, the cracking feedstock oil is selected from or comprises petroleum hydrocarbons and/or other mineral oils, wherein petroleum hydrocarbons are selected from the group consisting of vacuum gas oil, atmospheric gas oil, coker gas oil, deasphalted oil, vacuum residue and atmospheric residue or combinations of two or more; other mineral oils are selected from the group consisting of coal liquefied oil, oil sand oil and shale oil, or combinations of two or more.

In a more preferred embodiment, the catalytic cracking catalyst comprises zeolites, inorganic oxides and optionally clays respectively in an amount of from 1 to 50 wt %, from 5 to 99 wt %, and from 0 to 70 wt % relative to the total weight of the catalyst, wherein the zeolites are medium pore zeolites and optionally large pore zeolites respectively in an amount of from 51 to 100 wt % (preferably from 70 to 100 wt %) and from 0 to 49 wt % relative to the total weight of the zeolites; the medium pore zeolites are selected from the group consisting of ZSM-series zeolites and/or ZRP zeolites; and the large pore zeolites are selected from the group consisting of Y-series zeolites.

The catalyst having a relatively homogeneous activity (including the catalytic cracking catalyst used in the catalytic cracking reactor and the catalyst for producing more diesel used in the unit for producing more diesel) has an initial activity of not higher than 80, preferably not higher than 75, more preferably not higher than 70, a self-balancing time ranging from 0.1 to 50 h, preferably from 0.2 to 30 h, more preferably from 0.5 to 10 h, and an equilibrium activity ranging from 35 to 60, preferably from 40 to 55.

The initial activity of the catalyst or the fresh catalyst activity as mentioned below means the catalyst activity evaluated by the light oil micro-reaction unit. It can be measured by the measuring method in the prior art: Enterprise standard RIPP 92-90—Micro-reaction test method for catalytic cracking fresh catalysts, *Petrochemical analytic method* (*RIPP test method*), Yang Cuiding et al, 1990 (hereinafter referred to as RIPP 92-90). The initial activity of the catalyst is represented by light oil micro-reaction activity (MA), calculated by the formula MA=(output of the gasoline having a temperature less than 204° C. in the product+gas output+coke output)/total weight of the feedstock oil*100%=the yield of the gasoline having a temperature less than 204° C. in the product+gas yield+coke yield. The evaluation conditions of the light oil micro-reaction unit (referring to RIPP 92-90) include pulverizing the catalyst into particles having a particle diameter of 420-841 μm; the weight being 5 g; the reaction materials being straightrun light diesel fuel having a distillation range of 235-337° C.; the reaction temperature being 460° C.; the weight hourly space velocity being 16 $h^{-1}$; and the catalyst/oil ratio being 3.2.

The self-balancing time of the catalyst is the time necessary for achieving the equilibrium activity by ageing at 800° C. and 100% water vapor (by reference to RIPP 92-90).

The catalyst having a relatively homogeneous activity is obtainable by, for example, the following three processing methods.

The catalyst-processing method 1:

(1) feeding a fresh catalyst into the fluidized bed, preferably a dense phase fluidized bed, contacting with water vapor, ageing under a certain hydrothermal circumstance to obtain a catalyst having a relatively homogeneous activity; and (2) feeding the catalyst having a relatively homogeneous activity into the corresponding reaction unit.

The processing method 1 is specifically carried out, for example, as follows.

A fresh catalyst is fed into a fluidized bed, preferably a dense phase fluidized bed, and water vapor is fed into the bottom of the fluidized bed. The fluidization of the catalyst is achieved under the action of water vapor, and the catalyst is aged by water vapor at the same time to obtain the catalyst having a relatively homogeneous activity. The ageing temperature ranges from 400° C. to 850° C., preferably from 500° C. to 750° C., more preferably from 600° C. to 700° C. The superficial linear velocity of the fluidized bed ranges from 0.1 to 0.6 m/s, preferably from 0.15 to 0.5 m/s. The ageing time ranges from 1 to 720 h, preferably from 5 to 360 h. According to the requirements on the industrial unit, the catalyst having a relatively homogeneous activity is added into the industrial unit, preferably into the regenerator of the industrial unit.

The catalyst-processing method 2:

(1) feeding a fresh catalyst into the fluidized bed, preferably a dense phase fluidized bed, contacting with an ageing medium containing water vapor, ageing under a certain hydrothermal circumstance to obtain a catalyst having a relatively homogeneous activity; and (2) feeding the catalyst having a relatively homogeneous activity into the corresponding reaction unit.

The technical solution of the processing method 2 is specifically carried out, for example, as follows.

A fresh catalyst is fed into a fluidized bed, preferably a dense phase fluidized bed, and an ageing medium containing water vapor is fed into the bottom of the fluidized bed. The fluidization of the catalyst is achieved under the action of the ageing medium containing water vapor, and the catalyst is aged by the ageing medium containing water vapor at the same time to obtain the catalyst having a relatively homogeneous activity. The ageing temperature ranges from 400° C. to 850° C., preferably from 500° C. to 750° C., more preferably from 600° C. to 700° C. The superficial linear velocity of the fluidized bed ranges from 0.1 to 0.6 m/s, preferably from 0.15 to 0.5 m/s. The weight ratio of water vapor to the ageing medium ranges from 0.20 to 0.9, preferably from 0.40 to 0.60. The ageing time ranges from 1 to 720 h, preferably from 5 to 360 h. According to the requirements on the industrial unit, the catalyst having a relatively homogeneous activity is added into the industrial unit, preferably into the regenerator of the industrial unit. The ageing medium comprises air, dry gas, regenerated flue gas, gas obtained by combusting air and dry gas or gas obtained by combusting air and burning oil, or other gases such as nitrogen gas. The weight ratio of water vapor and ageing medium ranges from 0.2 to 0.9, preferably from 0.40-0.60.

The catalyst-processing method 3:

(1) feeding a fresh catalyst into a fluidized bed, preferably a dense phase fluidized bed, feeding the hot regenerated catalyst in the regenerator into the fluidized bed, and heat exchanging the fresh catalyst and the hot regenerated catalyst in the fluidized bed;

(2) contacting the heat exchanged fresh catalyst with water vapor or the ageing medium containing water vapor, ageing under a certain hydrothermal circumstance to obtain a catalyst having a relatively homogeneous activity; and (3) feeding the catalyst having a relatively homogeneous activity into the corresponding reaction unit.

The technical solution of the present invention is specifically carried out, for example, as follows.

A fresh catalyst is fed into a fluidized bed, preferably a dense phase fluidized bed, and the hot regenerated catalyst in the regenerator is fed into the fluidized bed at the same time to heat exchange in the fluidized bed. Water vapor or an ageing medium containing water vapor is fed into the bottom of the fluidized bed. The fluidization of the fresh catalyst is achieved under the action of water vapor or the ageing medium containing water vapor, and the fresh catalyst is aged by water vapor or the ageing medium containing water vapor at the same time to obtain the catalyst having a relatively homogeneous activity. The ageing temperature ranges from 400° C. to 850° C., preferably from 500° C. to 750° C., more preferably from 600° C. to 700° C. The superficial linear velocity of the fluidized bed ranges from 0.1 to 0.6 m/s, preferably from 0.15 to 0.5 m/s. The ageing time ranges from 1 to 720 h, preferably from 5 to 360 h. Under the circumstance of the ageing medium containing water vapor, the weight ratio of water vapor to the ageing medium is greater than 0-4, preferably ranges from 0.5 to 1.5. According to the requirements on the industrial unit, the catalyst having a relatively homogeneous activity is added into the industrial unit, preferably into the regenerator of the industrial unit. In addition, water vapor after the ageing step is fed into the reaction system (as one or more selected from the group consisting of stripping steam, anticoking steam, atomizing steam and lifting steam, and respectively added into the stripper, settler, feedstock nozzle and prelifting zone of the catalytic cracking unit) or the regeneration system. The ageing medium containing water vapor after the ageing step is fed into the regeneration system, and the heat exchanged regenerated catalyst is recycled back to the regenerator. The ageing medium comprises air, dry gas, regenerated flue gas, gas obtained by combusting air and dry gas or gas obtained by combusting air and burning oil, or other gases such as nitrogen gas.

It has been surprisingly found that, by the aforesaid processing methods, the activity and selectivity distribution of the catalyst in the industrial reaction unit are more homogeneous; the selectivity of the catalyst is notably improved so as to obviously decrease the dry gas and coke yields.

The particle size distribution of the catalyst (including the catalytic cracking catalyst and the catalyst for producing more diesel) may be the particle size distribution of the conventional catalyst or the coarse (big) particle size distribution. In a more preferred embodiment, the catalyst is characterized in using the catalyst having a coarse particle size distribution.

The catalytic cracking catalyst having a coarse particle size distribution comprise less than 10 vol. %, preferably less than 5 vol. % of the particles of the catalytic cracking catalyst having a particle size of less than 40 μm relative to the volume of all the particles of the catalytic cracking catalyst, less than 15 vol. %, preferably less than 10 vol. % of the particles of the catalytic cracking catalyst having a particle size of greater than 80 μm relative to the volume of all the particles of the catalytic cracking catalyst, the remaining being the particles of the catalytic cracking catalyst having a particle size of from 40 to 80 μm.

The particle size distribution of the catalyst for producing more diesel in the unit for producing more diesel is a coarse particle size distribution. The screening composition of the catalyst comprise less than 10 vol. %, preferably less than 5 vol. % of the particles of the catalyst for producing more diesel having a particle size of less than 40 μm relative to the volume of all the particles of the catalyst for producing more diesel, less than 15 vol. %, preferably less than 10 vol. % of the particles of the catalyst for producing more diesel having a particle size of greater than 80 μm relative to the volume of all the particles of the catalyst for producing more diesel, the remaining being the particles of the catalyst for producing more diesel having a particle size of from 40 to 80 μm.

In a more preferred embodiment, the catalytic cracking reactor is selected from the group consisting of a riser, a fluidized bed with an equal linear velocity, a fluidized bed with an equal diameter, an upstream conveyor line and a downstream conveyor line or combinations of two or more, or combinations of two or more same reactors, wherein the combinations comprises combinations in series or/and parallel; the riser is a conventional one with an equal diameter or one with various variable diameters.

In a more preferred embodiment, the reaction conditions for the re-cracked feedstock oil comprises a reaction temperature of from 600 to 750° C., a weight hourly space velocity of from 100 to 800 $h^{-1}$, a reaction pressure of from 0.10 to 1.0 MPa, a catalyst/re-cracked feedstock oil weight ratio of from 30 to 150, and a water vapor/re-cracked feedstock oil weight ratio of from 0.05 to 1.0.

In a more preferred embodiment, the reaction conditions for the cracking feedstock oil comprises a reaction temperature of from 450 to 600° C., a weight hourly space velocity of from 5 to 100 $h^{-1}$, a reaction pressure of from 0.10 to 1.0 MPa, a catalyst/cracking feedstock oil weight ratio of from 1.0 to 30, and a water vapor/cracking feedstock oil weight ratio of from 0.05 to 1.0.

In a more preferred embodiment, the reaction conditions for the cracking feedstock oil comprises a reaction temperature of from 460 to 580° C., a weight hourly space velocity of from 10 to 90 $h^{-1}$, preferably from 20 to 60 $h^{-1}$, more preferably from 30 to 50 $h^{-1}$, a catalyst/feedstock oil weight ratio of from 1 to 14, preferably from 3-14.

In a more preferred embodiment, the process further comprises separating the catalytic cracking reaction product from the catalytic cracking catalyst, stripping and coke-burning the separated catalytic cracking catalyst and recycling to the catalytic cracking reactor, wherein the separated product comprises propylene, high cetane number diesel and fluid catalytic cracking gas oil.

In a more preferred embodiment, the fluid catalytic cracking gas oil is a fraction having an initial boiling point of not less than 260° C. and a hydrogen content of not less than 10.5 wt %.

In a more preferred embodiment, the fluid catalytic cracking gas oil is a fraction having an initial boiling point of not less than 330° C. and a hydrogen content of not less than 10.8 wt %.

The hydrogenating reaction system is usually a fixed bed reactor, and the hydrogenating catalyst is a non-noble Group VIB or/and Group VIII metal catalyst supported on the amorphous alumina or/and silicon-aluminium carrier, wherein the non-noble Group VIB metal is molybdenum or/and tungsten; and the non-noble Group VIII metal is one or more selected from nickel, cobalt and iron.

The hydrogenation is conducted under the processing conditions of a hydrogen partial pressure of from 4.0 to 20.0 MPa, a reaction temperature of from 280 to 450° C., a volume hourly space velocity of 0.1 to 20 $h^{-1}$, and a hydrogen/oil ratio of from 300 to 2000 v/v.

The current aromatic hydrocarbon extraction unit is applicable for the aromatic hydrocarbon extraction unit in the process. The solvent for the aromatic hydrocarbon extraction is one or more selected from the group consisting of furfural, dimethylsulfoxide, dimethyl formamide, monoethanolamine, ethylene glycol, and 1,2-propylene glycol. The solvent is recoverable; the extraction is conducted at a temperature of from 40 to 120° C.; and the solvent/fluid catalytic cracking gas oil volume ratios ranges from 0.5:1 to 5.0:1.

The hydrocracking reaction system usually comprises a refining reactor and a cracking reactor, which both are the fixed bed reactors. The refining reactor is usually filled with a hydrogenating catalyst. The hydrogenating catalyst is a non-noble Group VIB or/and Group VIII metal catalyst supported on the amorphous alumina or/and silicon-aluminium carrier, and the hydrocracking catalyst is a non-noble Group VIB or/and Group VIII metal catalyst supported on the Y-type zeolite molecular sieves, wherein the non-noble Group VIB metal is molybdenum or/and tungsten; and the non-noble Group VIII metal is one or more selected from nickel, cobalt and iron.

The hydrocracking is conducted under the processing conditions of a hydrogen partial pressure of from 4.0 to 20.0 MPa, a reaction temperature of from 280 to 450° C., a volume hourly space velocity of 0.1 to 20 $h^{-1}$, and a hydrogen/oil ratio of from 300 to 2000 v/v.

In a more preferred embodiment, the unit for producing more diesel has a reaction temperature ranging from 400 to 650° C., preferably from 430 to 500° C., more preferably from 430 to 480° C., an oil and gas residence time of from 0.05 to 5 seconds, preferably from 0.1 to 4 seconds and a reaction pressure of from 0.10 to 1.0 MPa.

In a more preferred embodiment, the catalyst for producing more diesel comprises zeolites, inorganic oxides and clays respectively in an amount of, based on the dry basis, from 5 to 60 wt % (preferably from 10 to 30 wt %); from 0.5 to 50 wt %; and from 0 to 70 wt % relative to the total weight of the catalyst, wherein the zeolites as the active ingredients are selected from large pore zeolites which are selected from the group consisting of rare earth Y, hydrogen rare earth Y, ultrastable Y obtained by various methods and high-silicon Y, or combinations of two or more. The inorganic oxide as the substrate is selected from the group consisting of $SiO_2$ and/or $Al_2O_3$. On the basis of dry basis, $SiO_2$ ranges from 50 to 90 wt %, and $Al_2O_3$ ranges from 10 to 50 wt % relative to the weight of the inorganic oxide. The clay as the binder is one or more selected from the group consisting of kaolin, meta halloysite, montmorillonite, diatomite, halloysite, saponite, rectorite, sepiolite, attapulgite, hydrotalcite, and bentonite.

In a more preferred embodiment, the reactor for producing more diesel is selected from the group consisting of a riser, a fluidized bed with an equal linear velocity, a fluidized bed with an equal diameter, an upstream conveyor line and a downstream conveyor line or combinations of two or more, or combinations of two or more same reactors, wherein the combinations comprises combinations in series or/and parallel; the riser is a conventional one with an equal diameter or one with various variable diameters.

In a more preferred embodiment, the hydrogenated fluid catalytic cracking gas oil or/and the fluid catalytic cracking gas oil raffinate obtained by the solvent extraction or/and the hydrocracked tail oil obtained by hydrocracking the fluid catalytic cracking gas oil is/are fed into the reactor for producing more diesel at one position, or the hydrogenated fluid catalytic cracking gas oil is fed into the reactor for producing more diesel at two or more positions at the same or different heights.

In a more preferred embodiment, the process for producing more diesel further comprises separating the reaction product in the reactor for producing more diesel from the catalyst for producing more diesel, stripping and coke-burning the separated catalyst for producing more diesel and recycling to the reactor for producing more diesel, wherein the separated product comprises high cetane number diesel and propylene.

In order to increase the catalyst/oil ratio and the catalytic activity of the catalyst in the downstream reaction zone, hot or cold regenerated catalysts, semi-regenerated catalysts, catalysts to be regenerated and fresh catalyst may be supplemented. By cooling after regeneration, the cooled regenerated catalysts and semi-regenerated catalysts are obtained from the catalysts to be regenerated respectively via two-stage and one-stage regeneration. The regenerated catalysts have a carbon content of less than 0.1 wt %, preferably less than 0.05 wt %; the semi-regenerated catalysts have a carbon content of from 0.1 to 0.9 wt %, preferably from 0.15 to 0.7 wt %; the catalysts to be regenerated have a carbon content of greater than 0.9 wt %, preferably from 0.9 to 1.2 wt %.

The methods for separating propylene and the like from the reaction product are the same as those well known by those ordinarily skilled in the art.

The technical solution organically combines the processes such as catalyst cracking, hydrogenation of fluid catalytic cracking gas oil and the like, so as to make maximum production of high cetane number diesel low carbon olefins, in particular propylene, from heavy feedstocks having a lower hydrogen content.

The present invention has the following technical advantages as compared with the prior art:

1. While more diesel is produced, the propylene yield and the selectivity of propylene in the liquefied gas are greatly increased, and the diesel cetane number is notably improved.
2. Under the circumstances that the propylene yield and diesel are greatly increased, the dry gas yield and coke are notably decreased.
3. The light oil yield is notably increased, and the oil slurry yield is notably decreased, so as to improve the utilization efficiency of petroleum resources.
4. The operation cycles of the hydrogenation or/and aromatic hydrocarbon extracting or/and hydrocracking unit are obviously enhanced.
5. Since the catalyst particles are more homogeneous, the local temperature distribution of the catalyst during the regeneration is more homogeneous, and the fracture tendency of the catalyst is also correspondingly decreased.
6. The catalyst consumption is reduced, and the catalyst content in the fluid catalytic cracking gas oil is decreased.

Unless otherwise defined, all technical and scientific terms used herein have the same meaning as commonly understood by one of ordinary skill in the art to which the present invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

As used herein, the term "comprising" means that other steps and ingredients that do not affect the final result can be added. This term encompasses the terms "consisting of" and "consisting essentially of".

The term "method" or "process" refers to manners, means, techniques and procedures for accomplishing a given task including, but not limited to, those manners, means, techniques and procedures either known to, or readily developed from known manners, means, techniques and procedures by practitioners of the chemical and chemical engineering.

Throughout this disclosure, various aspects of the present invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "between" a first indicate number and a second indicate number and "ranging/ranges from" a first indicate number "to" a second indicate number are used herein interchangeably and are meant to include the first and second indicated numbers and all the fractional and integral numerals therebetween.

BRIEF DESCRIPTION OF THE DRAWINGS

The present invention is herein described, by way of example only, with reference to the accompanying drawings. With specific reference now to the drawings in detail, it is stressed that the particulars shown are by way of example and for purposes of illustrative description of the preferred embodiments of the present invention only, and are presented in the cause of providing what is believed to be the most useful and readily understood description of the principles and conceptual aspects of the present invention. In this regard, no attempt is made to show structural details of the present invention in more detail than is necessary for a fundamental understanding of the invention, the description taken with the drawings making apparent to those skilled in the art how the several forms of the invention may be embodied in practice.

FIG. 1 is the schematic representation of one embodiment of the present invention.

DETAILED DESCRIPTION OF THE EMBODIMENTS

The drawings are intended to be illustrative, not limitative, for the processes provided in the present invention.

The technological process is stated as follows.

The pre-lifted medium is fed from the bottom of the riser reactor 2 via pipe line 1. The regenerated catalyst from pipe line 16 makes the accelerated upward motion along with the riser under the lifting action of the pre-lifted medium. The re-cracked feedstock oil from pipe line 3 and the atomized steam from pipe line 4 are fed into the bottom of the reaction zone I of the riser 2, and mixed with the existing stream in the riser reactor. The re-cracked feedstock oil is cracked on the hot catalyst and makes the accelerated upward motion. The cracking feedstock oil from pipe line 5 and the atomized steam from pipe line 6 are fed into the middle or upper part of the reaction zone I of the riser 2, and mixed with the existing stream in the riser reactor. The cracking feedstock oil is cracked on slightly coked catalyst and makes the accelerated upward motion into the reaction zone II for continuous reaction. The produced oil gas and the inactivated catalyst to be regenerated are fed into the cyclone separator in the settler 8 via pipe line 7, so as to separate the catalyst to be regenerated from oil gas. Oil gas is fed into the collection chamber 9, and the fine catalyst powder is recycled to the settler via the dipleg. The catalyst to be regenerated in the settler flows to the stripping zone 10, and is in contact with steam from pipe line 11. Oil gas stripped from the catalyst to be regenerated is fed into the collection chamber 9 via the cyclone separator. The stripped catalyst to be regenerated is fed into the regenerator 13 via the sloped tube 12, and the prevailing wind enters the regenerator via pipe line 14. Coke on the catalyst to be regenerated is burned off to regenerate the inactivated catalyst to be regenerated, and the flue gas enters the exhauster via pipeline 15. The regenerated catalyst is fed into the riser via the sloped tube 16.

Oil gas in the collector chamber 9 is fed into the subsequent separation system 18 via the main oil gas pipe line 17. The separated propylene is drawn out via pipeline 19; the separated propane is drawn out via pipeline 28; $C_4$ hydrocarbons are drawn out via pipeline 20, or may be recycled to the riser 2; the catalytically cracked dry gas is drawn out via pipeline 21; the catalytically cracked gasoline is drawn out via pipeline 27, wherein the gasoline fraction having a distillation range of less than 65-110° C. is drawn out via pipeline 22 and recycled to the reactor as the re-cracked feedstocks; the diesel fraction is drawn out via pipeline 29, or the heavy diesel fraction together with the fluid catalytic cracking gas oil are drawn out and fed into the hydrogenating unit or/and aromatic hydrocarbon extracting unit; the fluid catalytic cracking gas oil feedstocks are drawn out via pipeline 23 to the hydrogenating unit or/and the aromatic hydrocarbon extracting unit or/and hydrocracking unit 24, wherein the hydrogenated gas product or/and heavy aromatic hydrocarbons or/and the hydrocracked gas separated therefrom is/are drawn out via pipeline 25, and the hydrogenated fluid catalytic cracking gas oil or/and the fluid catalytic cracking gas oil raffinate or/and the hydrocracked tail oil of the fluid catalytic cracking gas oil is drawn out via pipeline 26 and fed into the unit 30 for producing more diesel. Gas oil produced in the unit for producing more diesel may be fed into the fractionating system 18 or/and other fractionating systems for separation via pipe line 31. The distillation range of each fraction can be adjusted according to the actual requirements of the refinery.

The following examples are used to demonstrate the effect of the present invention and are not meant to limit the scope of the invention to the detailed examples shown herein.

The feedstock oil used in the examples is VGO, and the properties thereof are listed in Table 1.

The process for preparing the catalytic cracking catalyst (CAT-MP) used in the examples is briefly stated as follows.

Process for Preparing the Catalyst CAT-MP 1) 20 g of $NH_4CL$ were dissolved in 1000 g of water. 100 g of (dry basis) the crystallized product ZRP-1 zeolites (Qilu Catalyst Factory of SINOPEC Catalyst Company, $SiO_2/Al_2O_3$=30, $RE_2O_3$=2.0 wt %) were added to such solution, exchanged at 90° C. for 0.5 h, and filtered to obtain a filter cake. 4.0 g of $H_3PO_4$ (having a concentration of 85%) and 4.5 g of $Fe(NO_3)_3$ were dissolved in 90 g of water, mixed with the filter cake, impregnated and oven-dried, calcinated at 550° C. for 2 h to obtain medium pore zeolites having the MFI structure and containing phosphor and iron, the chemical composition thereof obtained by element analysis being as follows:

$$0.1Na_2O.5.1Al_2O_3.2.4P_2O_5.1.5Fe_2O_3.3.8RE_2O_3.88.1SiO_2.$$

2) 75.4 g of meta halloysite (industrially produced by Suzhou Kaolin Clay Company, and having a solid content of 71.6%) were slurried by 250 g of decationic water. Then 54.8 g of pseudo-boehmite (produced by Shandong Aluminum Company, and having a solid content of 63%) were added; and hydrochloric acid was added to adjust the pH thereof to 2-4, homogeneously stirred and stood for aging at 60-70° C. for 1 h. The pH thereof was maintained to be 2-4, and the temperature thereof was decreased to a temperature less than of 60° C. 41.5 Kg of alumina sols (produced by Qilu Catalyst Factory of SINOPEC Catalyst Company, having an $Al_2O_3$ content of 21.7 wt %) were added and stirred for 40 minutes to obtain a mixed slurry.

3) The medium pore zeolites having the MFI structure and containing phosphor and iron prepared in step 1) (having a dry basis of 22.5 Kg) and DASY zeolites (industrially produced by Qilu Catalyst Factory of SINOPEC Catalyst Company, having a unit cell constant of 2.445-2.448 nm and a dry basis of 2.0 Kg) were added into the mixed slurry obtained in step 2), homogeneously stirred, dried by spraying and shaped, washed with ammonium dihydrogen phosphate solution (having a phosphor content of 1 wt %) to remove free $Na^+$, and dried to obtain a catalytic cracking catalyst sample CAT-MP consisting of 18 wt % of medium pore zeolites having the MFI structure and containing phosphor and iron, 2 wt % of DASY zeolites, 28 wt % of pseudo-boehmite, 7 wt % of alumina sols and the balance being kaolin.

4) The prepared catalyst was aged in the dense phase bed under the conditions of 700° C. and 100% water vapor, wherein the fluidized bed had a superficial linear velocity of 0.28 m/s; and the ageing lasted 17 h. The properties of the aged catalyst are listed in Table 2, and the code name of the catalyst is CAT-MP-1. A part of the ageing agent was elutriated to remove fine particles and particles having a particle size of greater than 100 μm, so as to obtain the catalyst having a coarse particle size distribution, wherein the code name thereof is CAT-MP-2, and the properties thereof are listed in Table 2.

The process for preparing the catalyst (CAT-MD) for producing more diesel in the examples is briefly stated as follows.

Process for Preparing the Catalyst CAT-MD 1) 2 L of a water glass solution having a silicon dioxide concentration of 155 g/L and 1 L of an acidified aluminium sulphate solution having a free acid concentration of 148 g/L and an $Al_2O_3$ content of 20 g/L were formulated, simultaneously fed into the flash mixer, and reacted to obtain a silica sol.

2) 465 g of kaolin (industrially produced by Suzhou Kaolin Clay Company, and having a solid content of 80%) were added into the silica sol prepared above, slurried for 1 h to obtain a kaolin-silica sol.

3) Pseudo-boehmite containing 124 g $Al_2O_3$ (produced by Shandong Aluminum Company, and having an $Al_2O_3$ content of 33%) and 450 g of deionized water were mixed and slurried for 30 minutes. Then 25 ml of hydrochloric acid having a concentration of 31 wt % (acid/$Al_2O_3$ molar ratio thereof being 0.2) were added, peptized, and continuously slurried for 2 h. 656 g of the ground DASY0.0 molecular sieve shiny (produced by Qilu Catalyst Factory of SINOPEC Catalyst Company, and having a unit cell constant of 2.445 nm) having a molecular sieve content of 32 wt % were added and slurried for 30 minutes to obtain a mixed slurry of pseudo-boehmite and molecular sieve.

4) The kaolin-silica sol slurry and the mixed slurry of pseudo-boehmite and molecular sieve prepared above were mixed and slurried for 10 minutes to obtain a catalyst slurry. The resultant catalyst slurry was dried at 180° C. by spraying to obtain particles having a diameter of 20-120 μm, a silica content of 29.9 wt %, a kaolin content of 35.9 wt %, an alumina content of 13.9 wt % and a molecular sieve content of 20.3 wt %. The particles were washed with deionized water to the extent that there is no detected $Na^+$, dried at 150° C. to obtain the catalyst CAT-MD.

5) The prepared catalyst was aged in the dense phase bed under the conditions of 700° C. and 100% water vapor, wherein the fluidized bed had a superficial linear velocity of 0.27 m/s; and the ageing lasted 20 h. The properties of the aged catalyst are listed in Table 2, and the code name of the catalyst is CAT-MD-1. A part of the ageing agent was elutriated to remove fine particles and particles having a particle size of greater than 100 μm, so as to obtain the catalyst having a coarse particle size distribution, wherein the code name thereof is CAT-MD-2, and the properties thereof are listed in Table 2.

The process for preparing the hydrogenating catalyst in the examples is briefly stated as follows. Ammonium meta-tungstate ($(NH_4)_2W_4O_{13}.18H_2O$, chemically pure), nickel nitrate ($Ni(NO_3)_2.18H_2O$, chemically pure) and water were formulated into 200 mL of a solution. 50 g of an alumina carrier were added into the solution, impregnated at room temperature for 3 h, treated with ultrasonic wave for 30 minutes, cooled, filtered and dried in microwave oven for about 15 minutes. The resultant catalyst comprises 30.0 wt % $WO_3$, 3.1 wt % NiO and the remaining being alumina.

The fresh catalytic cracking catalysts CAT-MP-1 and CAT-MP-2 have an activity (initial activity) of 73, a self-balancing time of 9 h under the conditions of 800° C. and 100% water vapor and an equilibrium activity of 49.

The fresh catalysts CAT-MD-1 and CAT-MD-2 for producing more diesel have an activity (initial activity) of 80, a self-balancing time of 10 h under the conditions of 800° C. and 100% water vapor and an equilibrium activity of 52.

The catalytic cracking catalyst used in the comparison examples is produced by Qilu Catalyst Factory of SINOPEC Catalyst Company. It has the commodity number is MLC-500, an (initial activity of 91, a self-balancing time of 60 h and an equilibrium activity of 43. The properties of the aged catalyst are listed in Table 2.

The hydrorefining catalyst and hydrocracking catalyst used in the examples respectively have the commodity numbers of RN-2 and RT-1 and both are produced by Changling catalyst factory of SINOPEC Catalyst Company.

Example 1

Example 1 was conducted according to the procedures as shown in the drawings. The cracking feedstock oil was directly used as the feedstock for catalytic cracking. The catalyst CAT-MP-1 was used for the test conducted on the pilot plant. The cracking feedstock was fed into the middle or upper part of the reaction zone I, and cracked at a reaction temperature of 530° C., a weight hourly space velocity of 35 $h^{-1}$, a catalytic cracking catalyst/feedstock weight ratio of 4, and a water vapor/feedstock weight ratio of 0.15. In the reaction zone II, the gas oil was cracked at a reaction temperature of 490° C. and a water vapor/feedstock weight ratio of 0.15. The gas oil was separated in the settler from the catalyst with coke, and the product was cut according to the distillation range in the fractioning system to obtain propylene, butylene, gasoline, diesel and fluid catalytic cracking gas oil fractions. The fluid catalytic cracking gas oil was fed into the hydrogenating unit and hydrogenated under the conditions of a hydrogen partial pressure of 16.0 MPa, a reaction temperature of 350° C., a volume hourly space velocity of 1.5 $h^{-1}$. The hydrogenated fluid catalytic cracking gas oil was fed into the catalytic cracking unit for producing more diesel, contacted with the catalyst CAT-MD-1 for catalytic conversion. The operation conditions and product distribution are listed in Table 3.

According to Table 3, it can be seen that the propylene yield is as high as 14.31 wt %; the diesel yield is as high as 18.89 wt %; and the cetane number is 41.

Comparison Example 1

The pilot test in Comparison Example 1 was conducted in the conventional catalytic cracking unit, wherein the scheme for producing more propylene was used; the feedstock oil therein was the same as that in Example 1; the catalyst used therein was the MLC-500 catalyst having a conventional particle size distribution; the reaction temperature was 512° C.; and the catalyst/oil ratio was 6. The operation conditions and product distribution are listed in Table 3.

It can be seen from Table 3 that the propylene yield may reach to 6.53; the diesel yield was 12.58; the diesel cetane number was 36. As compared with Example 1, the total liquid yield in Comparison Example 1 (liquefied gas yield+gasoline yield+diesel yield) was notably decreased, and the liquefied gas yield/dry gas yield ratio was notably less than that in Example 1.

Example 2

Example 2 was conducted according to the procedures as shown in the drawings. The feedstock oil, test steps and methods were completely the same as those in Example 1, except that the catalytic cracking catalyst used therein was changed from CAT-MP-1 having a conventional particle size distribution to CAT-MP-2 having a coarse particle size distribution; and the catalyst for producing more diesel used therein was changed from CAT-MD-1 having a conventional particle size distribution to CAT-MD-2 having a coarse particle size distribution. The operating conditions and product distribution are listed in Table 3.

According to Table 3, it can be seen that the propylene yield is as high as 14.58 wt %; the diesel yield is as high as 19.77 wt %; and the cetane number is 41.

Example 3

Example 3 was conducted according to the procedures as shown in the drawings. The cracking feedstock oil was directly used as the feedstock for catalytic cracking. The catalyst CAT-MP-1 was used for the test conducted on the pilot plant. The cracking feedstock was fed into the middle or upper part of the reaction zone I, and butylene as the re-cracked feedstock was fed into the bottom of the reaction zone I. At the bottom of the reaction zone I, the re-cracked feedstock was cracked at a reaction temperature of 610° C., a weight hourly space velocity of 175 $h^{-1}$, a catalytic cracking catalyst/feedstock weight ratio of 70, and a water vapor/feedstock weight ratio of 0.20. In the middle and upper parts of the reaction zone I, the catalytic feedstock was cracked at a reaction temperature of 530° C., a weight hourly space velocity of 40 $h^{-1}$, a catalytic cracking catalyst/feedstock weight ratio of 4, and a water vapor/feedstock weight ratio of 0.15. In the reaction zone II, the gas oil was cracked at a reaction temperature of 480° C. and a water vapor/feedstock weight ratio of 0.15. The gas oil was separated in the settler from the catalyst with coke, and the product was cut according to the distillation range in the fractioning system to obtain propylene, butylene, gasoline, diesel and fluid catalytic cracking gas oil fractions. The fluid catalytic cracking gas oil was fed into the hydrocracking unit and hydrogenated under the conditions of a hydrogen partial pressure of 17.9/17.4 MPa, a reaction temperature of 374/371° C., a volume hourly space velocity of 0.95/1.2 $h^{-1}$, wherein the reaction system of the hydrocracking unit comprised a refining reactor and a cracking reactor. After hydrogenation, the hydrocracked tail oil was fed into the catalytic cracking unit for producing more diesel, contacted with the catalyst CAT-MD-1 for catalytic conversion. The operation conditions and product distribution are listed in Table 4.

According to Table 4, it can be seen that the propylene yield is as high as 13.10 wt %; the diesel yield is as high as 11.36 wt %; the cetane number is as high as 52; and the jet fuel yield is 13.33 wt %.

As compared with Comparison Example 1, the propylene yield in Example 3 was notably increased by 6.57%; the diesel cetane number was also notably increased by 16 units; the total liquid yield (liquefied gas yield+gasoline yield+diesel yield+jet fuel yield) was notably increased by 3.94%; and the liquefied gas yield/dry gas yield ratio was comparatively lower.

Example 4

Example 4 was also conducted according to the procedures as shown in the drawings. The feedstock oil, test steps and methods were completely the same as those in Example 3, except that the catalytic cracking catalyst used therein was changed from CAT-MP-1 having a conventional particle size distribution to CAT-MP-2 having a coarse particle size distribution; and the catalyst for producing more diesel used therein was changed from CAT-MD-1 having a conventional particle size distribution to CAT-MD-2 having a coarse particle size distribution. The operating conditions and product distribution are listed in Table 4.

According to Table 4, it can be seen that the propylene yield is as high as 13.16 wt %; the diesel yield is as high as 12.03 wt %; the cetane number is 54; and the jet fuel yield is 13.85 wt %.

TABLE 1

| Properties of feedstocks | |
|---|---|
| Density (20° C.), kg/cm$^3$ | 858.6 |
| Kinematic viscosity (100° C.), mm$^2$/s | 4.9 |
| Carbon residue, wt % | 0.03 |
| Total nitrogen content, wt % | 0.05 |
| Sulfur, wt % | 0.06 |
| C, wt % | 86.3 |
| H, wt % | 13.64 |
| Heavy metal content, ppm | |
| Ni | <0.1 |
| V | <0.1 |
| Boiling range, ° C. | |
| IBP (Initial Boiling Point) | 290 |
| 10% | 372 |
| 30% | 415 |
| 50% | 440 |
| 70% | 470 |
| 90% | 502 |
| Final boiling point | — |

TABLE 2

| | Name of Catalyst | | | | |
|---|---|---|---|---|---|
| | CAT-MP-1 | CAT-MP-2 | CAT-MD-1 | CAT-MD-2 | MLC-500 |
| Type of particles | Conventional particle size | Coarse particle size | Conventional particle size | Coarse particle size | Conventional particle size |
| Chemical properties, wt % | | | | | |
| $Al_2O_3$ | 50.4 | 50.1 | 13.9 | 14.2 | 48.5 |
| $Fe_2O_3$ | 0.6 | 0.6 | | | |
| $Na_2O$ | 0.07 | 0.06 | 0.09 | 0.06 | 0.35 |
| Physical properties | | | | | |
| Specific surface area, $m^2/g$ | 104 | 97 | 106 | 97 | / |
| Pore volume, mL/g | 0.22 | 0.20 | 0.16 | 0.14 | / |
| Particle size distribution, vol. % | | | | | |
| 0-40 μm | 25.8 | 6.8 | 20.2 | 7.6 | 18.5 |
| 40-80 μm | 57.5 | 78.6 | 50.1 | 77.7 | 50.3 |
| >80 μm | 16.7 | 14.6 | 29.7 | 14.7 | 31.2 |

TABLE 3

| | Example 1 | Comp. Exp. 1 | Example 2 |
|---|---|---|---|
| Catalytic cracking unit | | | |
| Catalysts | CAT-MP-1 | | CAT-MP-2 |
| Operation conditions | | | |
| Riser reaction zone II | | | |
| Reaction temperature, ° C. | 490 | | 490 |
| Water vapor/feedstock oil weight ratio | 0.15 | | 0.15 |
| Riser reaction zone I | | | |
| Reaction temperature, ° C. | 530 | | 530 |
| Catalyst/oil ratio, m/m | 4 | | 4 |
| Weight hourly space velocity, $h^{-1}$ | 35 | | 35 |
| Water vapor/feedstock oil weight ratio | 0.15 | | 0.15 |
| Weight percent of the fluid catalytic cracking gas oil in the catalytic cracking reaction product, relative to the cracking feedstock oil, % | 37.13 | | 38.38 |
| Hydrogenating unit | | | |
| Hydrogen partial pressure, MPa | 16 | | 16 |
| Reaction temperature, ° C. | 350 | | 350 |
| Volume hourly space velocity, $h^{-1}$ | 1.5 | | 1.5 |
| Hydrogen/oil ratio, v/v | 1500 | | 1500 |
| Catalytic cracking unit for producing more diesel | Producing diesel | Conventional FCC | Producing diesel |
| Catalysts | CAT-MD-1 | MLC-500 | CAT-MD-2 |
| Reaction temperature, ° C. | 480 | 512 | 480 |
| Catalyst/oil ratio, m/m | 3 | 6 | 3 |
| Product distribution, m % | | | |
| Dry gas | 4.34 | 2.78 | 3.98 |
| Liquefied gas | 38.46 | 19.81 | 38.08 |
| Propylene | 14.31 | 6.53 | 14.58 |
| Gasoline | 32.72 | 54.65 | 33.10 |
| Diesel | 18.89 | 12.58 | 19.77 |
| Heavy oil | 0.37 | 5.12 | 0.08 |
| Coke | 5.30 | 4.56 | 5.09 |

TABLE 3-continued

| | Example 1 | Comp. Exp. 1 | Example 2 |
|---|---|---|---|
| Loss | 0.50 | 0.50 | 0.50 |
| Total | 100.58 | 100.00 | 100.60 |
| Diesel cetane number | 41 | 36 | 41 |
| Total liquid yield | 90.07 | 87.04 | 90.95 |
| Liquefied gas yield/dry gas yield | 8.86 | 7.13 | 9.57 |

TABLE 4

| | Example 3 | Comp. Exp. 1 | Example 4 |
|---|---|---|---|
| Catalytic cracking unit | | | |
| Catalysts | CAT-MP-1 | | CAT-MP-2 |
| Operation conditions | | | |
| Riser reaction zone II | | | |
| Reaction temperature, ° C. | 480 | | 480 |
| Water vapor/feedstock oil weight ratio | 0.15 | | 0.15 |
| Riser reaction zone I | | | |
| Reaction temperature, ° C. | 610/530 | | 610/530 |
| Catalyst/oil ratio, m/m | 70/4 | | 70/4 |
| Weight hourly space velocity, $h^{-1}$ | 175/40 | | 175/40 |
| Water vapor/feedstock oil weight ratio | 0.2/0.15 | | 0.2/0.15 |
| Weight percent of the fluid catalytic cracking gas oil in the catalytic cracking reaction product, relative to the cracking feedstock oil, % | 39.83 | | 40.19 |
| Hydrogenating unit | | | |
| Hydrogen partial pressure, MPa | 17.9/17.4 | | 17.9/17.4 |
| Reaction temperature, ° C. | 374/371 | | 374/371 |

TABLE 4-continued

| | Example 3 | Comp. Exp. 1 | Example 4 |
|---|---|---|---|
| Volume hourly space velocity, $h^{-1}$ | 0.95/1.2 | | 0.95/1.2 |
| Hydrogen/oil ratio, v/v | 1500 | | 1500 |
| Catalytic cracking unit for producing more diesel | | Conventional FCC | |
| Catalysts | CAT-MD-1 | MLC-500 | CAT-MD-2 |
| Reaction temperature, ° C. | 480 | 512 | 480 |
| Catalyst/oil ratio, m/m | 3 | 6 | 3 |
| Product distribution, m % | | | |
| Dry gas | 4.65 | 2.78 | 4.28 |
| Liquefied gas | 36.96 | 19.81 | 36.53 |
| Propylene | 13.10 | 6.53 | 13.16 |
| Gasoline | 29.33 | 54.65 | 29.34 |
| Jet fuel | 13.33 | 12.58 | 13.85 |
| Diesel | 11.36 | 5.12 | 12.03 |
| Coke | 4.65 | 4.56 | 4.37 |
| Loss | 0.50 | 0.50 | 0.50 |
| Total | 100.78 | 100.00 | 100.90 |
| Diesel cetane number | 52 | 36 | 54 |

It is appreciated that certain aspects and characteristics of the invention, which are, for clarity, described in the context of separate embodiments, may also be provided in combination in a single embodiment. Conversely, various aspects and characteristics of the invention, which are, for brevity, described in the context of a single embodiment, may also be provided separately or in any suitable sub-combination.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

While the invention has been described in conjunction with specific embodiments and examples thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A catalytic conversion process for producing more diesel and propylene, characterized in contacting the feedstock oil with a catalytic cracking catalyst in a catalytic cracking reactor, wherein the reaction temperature, weight hourly space velocity and weight ratio of the catalyst/feedstock oil are sufficient to obtain a reaction product containing from 12 to 60% by weight of a fluid catalytic cracking gas oil relative to the weight of the feedstock oil; the weight hourly space velocity is from 25 to 100 $h^{-1}$; the reaction temperature ranges from 450 to 600° C.; the weight ratio of the catalytic cracking catalyst/feedstock oil is 1-30; and the fluid catalytic cracking gas oil is fed into at least one of a hydrogenation device, a solvent extraction device and a hydrocracking device for further processing, wherein the catalytic cracking catalyst in the catalytic cracking reactor has a coarse particle size distribution, and wherein less than 10 vol. % of the catalytic cracking catalyst particles have a particle size of less than 40 μm relative to the volume of all the catalytic cracking catalyst particles, less than 15 vol. % of the catalytic cracking catalyst particles have a particle size of greater than 80 μm relative to the volume of all the catalytic cracking catalyst particles, and the remaining are the catalytic cracking catalyst particles having a particle size of from 40 to 80 μm.

2. The process according to claim 1, characterized in that the feedstock oil is selected from or comprises petroleum hydrocarbons and/or other mineral oils, wherein petroleum hydrocarbons are selected from the group consisting of vacuum gas oil, atmospheric gas oil, coker gas oil, deasphalted oil, vacuum residue and atmospheric residue or combinations of two or more; other mineral oils are selected from the group consisting of coal liquefied oil, oil sand oil and shale oil, or combinations of two or more.

3. The process according to claim 1, characterized in that the catalytic cracking catalyst in the catalytic cracking reactor comprises zeolites, inorganic oxides and optionally clays respectively in an amount of from 1 to 50 wt %, from 5 to 99 wt %, and from 0 to 70 wt % relative to the total weight of the catalyst, wherein the zeolites are medium pore zeolites and optionally large pore zeolites respectively in an amount of from 51 to 100 wt % and from 0 to 49 wt % relative to the total weight of the zeolites; the medium pore zeolites are selected from the group consisting of ZSM-series zeolites and/or ZRP zeolites; and the large pore zeolites are selected from the group consisting of Y-series zeolites.

4. The process according to claim 1, characterized in that the catalytic cracking reactor is selected from the group consisting of a riser, a fluidized bed with an equal linear velocity, a fluidized bed with an equal diameter, an upstream conveyor line and a downstream conveyor line or combinations of two or more, or combinations of two or more same reactors, wherein the combinations comprises combinations in series or/and parallel; the riser is a conventional one with an equal diameter or one with various variable diameters.

5. The process according to claim 1, characterized in that the feedstock oil is fed into the catalytic cracking reactor at one position, or at two or more positions at the same or different heights.

6. The process according to claim 1, characterized in that the reaction temperature range is 460 to 580° C.; the weight hourly space velocity range is from 30 to 80 $h^{-1}$; the weight ratio of the catalytic cracking catalyst/feedstock oil is 2-15; and the weight ratio of water vapor/cracking feedstock oil is 0.05-1.0.

7. The process according to claim 6 wherein the reaction temperature range is from 480 to 540° C.; the weight hourly space velocity range is from 40 to 60 $h^{-1}$; and the weight ratio of the catalytic cracking catalyst/feedstock oil is from 3-14.

8. The process according to claim 1, characterized in that the reaction is conducted at a pressure of from 0.10 to 1.0 MPa.

9. The process according to claim 1, characterized in further comprising separating the reaction product from the catalytic cracking catalyst, stripping and coke-burning the separated catalytic cracking catalyst and recycling to the reactor, wherein the separated product comprises propylene, high cetane number diesel and fluid catalytic cracking gas oil.

10. The process according to claim 1, characterized in that the fluid catalytic cracking gas oil is a fraction having an initial boiling point of not less than 260° C., and a hydrogen content of not less than 10.5 wt %.

11. The process according to claim 10 wherein the fluid catalytic cracking gas oil is a fraction having an initial boiling point of not less than 330° C.; and the hydrogen content is not less than 10.8%.

12. The process according to claim 1, characterized in that at least one of the hydrogenated fluid catalytic cracking gas oil obtained by hydrogenating the fluid catalytic cracking gas oil, the fluid catalytic cracking gas oil raffinate obtained by the solvent extraction device or the hydrocracked tail oil obtained by hydrocracking is used as the feedstocks for a unit for producing more diesel.

13. The process according to claim 12 wherein a catalyst for producing more diesel in the unit for producing more diesel has a coarse particle size distribution, wherein less than 10 vol. % of the particles of the catalyst for producing more diesel have a particle size of less than 40 μm relative to the volume of all the particles of the catalyst for producing more diesel, less than 15 vol. % of the particles of the catalyst for producing more diesel have a particle size of greater than 80 μm relative to the volume of all the particles of the catalyst for producing more diesel, and the remaining are the particles of the catalyst for producing more diesel having a particle size of from 40 to 80 μm.

14. The process according to claim 12, characterized in that the unit for producing more diesel has a reaction temperature ranging from 400 to 650° C., an oil and gas residence time of from 0.05 to 5 seconds and a reaction pressure of from 0.10 to 1.0 MPa.

15. The process according to claim 12, characterized in that the catalyst used for producing more diesel in the unit for producing more diesel comprises zeolites, inorganic oxides and clays respectively in an amount of, based on the dry basis, from 5 to 60 wt %, from 0.5 to 50 wt %, and from 0 to 70 wt % relative to the total weight of the catalyst, wherein the zeolites as the active ingredients are selected from large pore zeolites which are selected from the group consisting of rare earth Y, hydrogen rare earth Y, ultrastable Y obtained by various methods and high-silicon Y, or combinations of two or more.

16. The process according to claim 1 or 12, characterized in that the catalytic cracking catalyst in the catalytic cracking reactor and/or the catalyst for producing more diesel in the unit for producing more diesel are/is the catalyst cracking catalyst(s) having a relatively homogeneous activity, wherein the catalyst having a relatively homogeneous activity has an initial activity of not greater than 80, a self-balancing time of from 0.1 to 50 hours, and a equilibrium activity of from 35 to 60.

17. The process according to claim 1 or 12, characterized in that the catalytic cracking catalyst in the catalytic cracking reactor and/or the catalyst for producing more diesel in the unit for producing more diesel are/is obtained by the following steps:

(1) feeding a fresh catalyst into a fluidized bed, preferably a dense phase fluidized bed, contacting with water vapor, aging under a certain hydrothermal circumstance to obtain a catalyst having a relatively homogeneous activity; and (2) feeding the catalyst having a relatively homogeneous activity into the corresponding reaction unit, wherein said certain hydrothermal circumstance comprises an ageing temperature of from 400 to 850° C., a superficial linear velocity of the fluidized bed of from 0.1 to 0.6 m/s, and an ageing time of from 1 to 720 h.

18. The process according to claim 1 or 12, characterized in that the catalytic cracking catalyst in the catalytic cracking reactor and/or the catalyst for producing more diesel in the unit for producing more diesel are/is obtained by the following steps:

(1) feeding a fresh catalyst into a fluidized bed, preferably a dense phase fluidized bed, contacting with an ageing medium containing water vapor, aging under a certain hydrothermal circumstance to obtain a catalyst having a relatively homogeneous activity; and (2) feeding the catalyst having a relatively homogeneous activity into the corresponding reaction unit, wherein said certain hydrothermal circumstance comprises an ageing temperature of from 400 to 850° C., a superficial linear velocity of the fluidized bed of from 0.1 to 0.6 m/s, a water vapor/ageing medium weight ratio of from 0.20 to 0.9, and an ageing time of from 1 to 720 h.

19. The process according to claim 1 or 12, characterized in that the catalytic cracking catalyst in the catalytic cracking reactor and/or the catalyst for producing more diesel in the unit for producing more diesel are/is obtained by the following steps:

(1) feeding a fresh catalyst into a fluidized bed, feeding a hot regenerated catalyst in the regenerator into the fluidized bed, and heat exchanging the fresh catalyst and the hot regenerated catalyst in the fluidized bed;

(2) contacting the heat exchanged fresh catalyst with water vapor or the ageing medium containing water vapor, ageing under a certain hydrothermal circumstance to obtain a catalyst having a relatively homogeneous activity; and (3) feeding the catalyst having a relatively homogeneous activity into the corresponding reaction unit, wherein said certain hydrothermal circumstance comprises an ageing temperature of from 400 to 850° C., a superficial linear velocity of the fluidized bed of from 0.1 to 0.6 m/s, an ageing time of from 1 to 720 h, and a water vapor/ageing medium (if any) weight ratio of greater than 0-4.

20. The process according to claim 12, characterized in that the reactor for producing more diesel is selected from the group consisting of a riser, a fluidized bed with an equal linear velocity, a fluidized bed with an equal diameter, an upstream conveyor line and a downstream conveyor line or combinations of two or more, or combinations of two or more same reactors, wherein the combinations comprises combinations in series or/and parallel; the riser is a conventional one with an equal diameter or one with various variable diameters.

21. The process according to claim 12, characterized in that the hydrogenated fluid catalytic cracking gas oil or/and the fluid catalytic cracking gas oil raffinate obtained by the solvent extraction or/and the hydrocracked tail oil obtained by hydrocracking the resultant fluid catalytic cracking gas oil is/are fed into the reactor for producing more diesel at one position, or the hydrogenated fluid catalytic cracking gas oil is fed into the reactor for producing more diesel at two or more positions at the same or different heights.

22. The process according to claim 12, characterized in that the process conducted in the reactor for producing more diesel further comprises separating the reaction product from the catalyst for producing more diesel, stripping and coke-burning the catalyst for producing more diesel and recycling to the reactor for producing more diesel, wherein the separated product comprises high cetane number diesel and propylene.

23. The process according to claim 1 wherein less than 5 vol. % of the catalytic cracking catalyst particles have a particle size of less than 40 μm relative to the volume of all the catalytic cracking catalyst particles; and less than 10 vol. % of the catalytic cracking catalyst particles have a particle size of greater than 80 μm relative to the volume of all the catalytic cracking catalyst particles.

24. The process according to claim 16 wherein the initial activity is not greater than 75; the self-balancing time is from 0.2 to 30 hours; and the equilibrium activity is from 40 to 55.

25. The process according to claim 17 wherein the ageing temperature is from 500 to 750° C.; and the superficial linear velocity of the fluidized bed is from 0.15 to 0.5 m/s; and the ageing time is from 5 to 360 h.

26. The process according to claim 18 wherein the ageing temperature is from 500 to 750° C.; the superficial linear velocity of the fluidized bed is from 0.15 to 0.5 m/s; the water vapor/ageing medium weight ratio is from 0.40 to 0.60; and the ageing time is from 5 to 360 h.

27. The process according to claim 19 wherein the fluidized bed is a dense phase fluidized bed; the ageing temperature is from 500 to 750° C.; the superficial linear velocity of the fluidized bed is from 0.15 to 0.5 m/s; the ageing time is from 5 to 360 h; and the water vapor/ageing medium weight ratio is from 0.5 to 0.15.

28. A catalytic conversion process for producing more diesel and propylene, characterized in contacting the feedstock oil with a catalytic cracking catalyst in a catalytic cracking reactor, further comprising (1) introducing the feedstock oil comprising the re-cracked feedstock oil and the cracking feedstock oil into the catalytic cracking reactor at one position, at two or more positions at the same or different heights;

(2) reacting the re-cracked feedstock oil in the catalytic cracking reactor at a time not later than the reaction of the cracking feedstock oil;

(3) the reaction temperature, weight hourly space velocity and weight ratio of the catalyst/feedstock oil in said catalytic cracking reaction being sufficient to obtain a reaction product containing from 12 to 60% by weight of a fluid catalytic cracking gas oil relative to the weight of the cracking feedstock oil, wherein the weight hourly space velocity of the cracking feedstock oil is from 5 to 100 $h^{-1}$;

(4) the fluid catalytic cracking gas oil being fed into a hydrogenation or/and solvent extracting unit and/or hydrocracking unit for further processing; and (5) the hydrogenated fluid catalytic cracking gas oil obtained by hydrogenating the fluid catalytic cracking gas oil or/and the fluid catalytic cracking gas oil raffinate obtained by the solvent extraction or/and the hydrocracked tail oil obtained by hydrocracking being used as the feedstocks for a unit for producing more diesel, wherein the catalytic cracking catalyst in the catalytic cracking reactor and/or a catalyst for producing more diesel in the unit for producing more diesel have/has a coarse particle size distribution wherein less than 10 vol. %-of the particles of the catalyst for producing more diesel have a particle size of less than 40 μm relative to the volume of all the particles of the catalyst for producing more diesel, less than 15 vol. % of the particles of the catalyst for producing more diesel have a particle size of greater than 80 μm relative to the volume of all the particles of the catalyst for producing more diesel, and the remaining are the particles of the catalyst for producing more diesel having a particle size of from 40 to 80 μm; and/or less than 10 vol. % of the catalytic cracking catalyst particles have a particle size of less than 40 μm relative to the volume of all the catalytic cracking catalyst particles, less than 15 vol. % of the catalytic cracking catalyst particles have a particle size of greater than 80 μm relative to the volume of all the catalytic cracking catalyst particles, and the remaining are the catalytic cracking catalyst particles having a particle size of from 40 to 80 μm.

29. The process according to claim 28, characterized in the re-cracked feedstock oil is selected from the group consisting of or comprises one selected from the group consisting of oil slurry, diesel, gasoline, hydrocarbons having a carbon atom number of from 4 to 8, or combinations of two or more.

30. The process according to claim 28, characterized in that the cracking feedstock oil is selected from or comprises petroleum hydrocarbons and/or other mineral oils, wherein petroleum hydrocarbons are selected from the group consisting of vacuum gas oil, atmospheric gas oil, coker gas oil, deasphalted oil, vacuum residue and atmospheric residue or combinations of two or more; other mineral oils are selected from the group consisting of coal liquefied oil, oil sand oil and shale oil, or combinations of two or more.

31. The process according to claim 28, characterized in that the catalytic cracking catalyst comprises zeolites, inorganic oxides and optionally clays respectively in an amount of from 1 to 50 wt %, from 5 to 99 wt %, and from 0 to 70 wt % relative to the total weight of the catalyst, wherein the zeolites are medium pore zeolites and optionally large pore zeolites respectively in an amount of from 51 to 100 wt % and from 0 to 49 wt % relative to the total weight of the zeolites; the medium pore zeolites are selected from the group consisting of ZSM-series zeolites and/or ZRP zeolites; and the large pore zeolites are selected from the group consisting of Y-series zeolites.

32. The process according to claim 28, characterized in that the catalytic cracking catalyst in the catalytic cracking reactor and/or the catalyst for producing more diesel in the unit for producing more diesel are/is the catalyst cracking catalyst(s) having a relatively homogeneous activity, wherein the catalyst having a relatively homogeneous activity has an initial activity of not greater than 80, a self-balancing time of from 0.1 to 50 hours, and a equilibrium activity of from 35 to 60.

33. The process according to claim 28, characterized in that the catalytic cracking catalyst in the catalytic cracking reactor and/or the catalyst for producing more diesel in the unit for producing more diesel are/is obtained by the following steps:

(1) feeding a fresh catalyst into a fluidized bed, contacting with water vapor, aging under a certain hydrothermal circumstance to obtain a catalyst having a relatively homogeneous activity; and (2) feeding the catalyst having a relatively homogeneous activity into the corresponding reaction unit, wherein said certain hydrothermal circumstance comprises an ageing temperature of from 400 to 850° C., a superficial linear velocity of the fluidized bed of from 0.1 to 0.6 m/s, and an ageing time of from 1 to 720 h.

34. The process according to claim 28, characterized in that the catalytic cracking catalyst in the catalytic cracking reactor and/or the catalyst for producing more diesel in the unit for producing more diesel are/is obtained by the following steps:

(1) feeding a fresh catalyst into a fluidized bed, contacting with an ageing medium containing water vapor, aging under a certain hydrothermal circumstance to obtain a catalyst having a relatively homogeneous activity; and (2) feeding the catalyst having a relatively homogeneous activity into the corresponding reaction unit, wherein said certain hydrothermal circumstance comprises an ageing temperature of from 400 to 850° C., a superficial linear velocity of the fluidized bed of from 0.1 to 0.6 m/s, a water vapor/ageing medium weight ratio of from 0.20 to 0.9, and an ageing time of from 1 to 720 h.

35. The process according to claim 28, characterized in that the catalytic cracking catalyst in the catalytic cracking reactor and/or the catalyst for producing more diesel in the unit for producing more diesel are/is obtained by the following steps:

(1) feeding a fresh catalyst into a fluidized bed, feeding the hot regenerated catalyst in the regenerator into the fluidized bed, and heat exchanging the fresh catalyst and the hot regenerated catalyst in the fluidized bed;

(2) contacting the heat exchanged fresh catalyst with water vapor or the ageing medium containing water vapor, ageing under a certain hydrothermal circumstance to obtain a catalyst having a relatively homogeneous activity; and (3) feeding the catalyst having a relatively homogeneous activity into the corresponding reaction unit, wherein said certain hydrothermal circumstance comprises an ageing temperature of from 400 to 850° C., a superficial linear velocity of the fluidized bed of from 0.1 to 0.6 m/s, an ageing time of from 1 to 720 h, and a water vapor/ageing medium (if any) weight ratio of greater than 0-4.

36. The process according to claim 28, characterized in that the catalytic cracking reactor is selected from the group consisting of a riser, a fluidized bed with an equal linear velocity, a fluidized bed with an equal diameter, an upstream conveyor line and a downstream conveyor line or combinations of two or more, or combinations of two or more same reactors, wherein the combinations comprises combinations in series or/and parallel; the riser is a conventional one with an equal diameter or one with various variable diameters.

37. The process according to claim 28, characterized in that the re-cracked feedstock oil reacts under the conditions of a reaction temperature of from 600 to 750° C., a weight hourly space velocity ranges from 100 to 800 $h^{-1}$, a reaction pressure of from 0.10 to 1.0 MPa, a catalyst/re-cracked feedstock oil weight ratio of from 30 to 150, and a water vapor/re-cracked feedstock oil weight ratio of from 0.05 to 1.0.

38. The process according to claim 28, characterized in that the cracking feedstock oil reacts under the conditions of a reaction temperature of from 450 to 600° C., a weight hourly space velocity ranges from 5 to 100 $h^{-1}$, a reaction pressure of from 0.10 to 1.0 MPa, a catalyst/cracking feedstock oil weight ratio of from 1.0 to 30, and a water vapor/cracking feedstock oil weight ratio of from 0.05 to 1.0.

39. The process according to claim 28, characterized in that the process further comprises separating the catalytic cracking reaction product from the catalytic cracking catalyst, stripping and coke-burning the separated catalytic cracking catalyst and recycling to the reactor, wherein the separated product comprises propylene, high cetane number diesel and fluid catalytic cracking gas oil.

40. The process according to claim 28, characterized in that the fluid catalytic cracking gas oil is a fraction having an initial boiling point of not less than 260° C., and a hydrogen content of not less than 10.5 wt %.

41. The process according to claim 28, characterized in that the unit for producing more diesel has a reaction temperature ranging from 400 to 650° C., an oil and gas residence time of from 0.05 to 5 seconds and a reaction pressure of from 0.10 to 1.0 MPa.

42. The process according to claim 28, characterized in that the catalyst used for producing more diesel in the unit for producing more diesel comprises zeolites, inorganic oxides and clays respectively in an amount of, based on the dry basis, from 5 to 60 wt %, from 0.5 to 50 wt %, and from 0 to 70 wt % relative to the total weight of the catalyst, wherein the zeolites as the active ingredients are selected from large pore zeolites which are selected from the group consisting of rare earth Y, hydrogen rare earth Y, ultrastable Y obtained by various methods and high-silicon Y, or combinations of two or more.

43. The process according to claim 28, characterized in that the reactor for producing more diesel in the unit for producing more diesel is selected from the group consisting of a riser, a fluidized bed with an equal linear velocity, a fluidized bed with an equal diameter, an upstream conveyor line and a downstream conveyor line or combinations of two or more, or combinations of two or more same reactors, wherein the combinations comprises combinations in series or/and parallel; the riser is a conventional one with an equal diameter or one with various variable diameters.

44. The process according to claim 28, characterized in that the hydrogenated fluid catalytic cracking gas oil or/and the hydrocracked tail oil obtained by hydrocracking is/are fed into the reactor for producing more diesel in the unit for producing more diesel at one position, or at two or more positions at the same or different heights.

45. The process according to claim 28, characterized in that the process conducted in the unit for producing more diesel further comprises separating the reaction product in the in the reactor for producing more diesel from the catalyst for producing more diesel, stripping and coke-burning the catalyst for producing more diesel and recycling to the reactor for producing more diesel, wherein the separated product comprises high cetane number diesel and propylene.

46. The process according to claim 12 wherein less than 5 vol. % of the particles of the catalyst for producing said more diesel have a particle size of less than 40 μm relative to the volume of all the particles of the catalyst for producing said more diesel; and less than 10 vol. % of the particles of the catalyst for producing said more diesel have a particle size of greater than 80 μm relative to the volume of all the particles of the catalyst for producing said more diesel.

47. The process according to claim 24 wherein the initial activity is not greater than 70; and the self-balancing time is from 0.5 to 10 hours.

48. The process according to claim 28 wherein less than 5 vol. % of the particles of the catalyst for producing said more diesel have a particle size of less than 40 μm relative to the volume of all the particles of the catalyst for producing said more diesel; and wherein less than 10 vol. % of the particles of the catalyst for producing said more diesel have a particle size of greater than 80 μm relative to the volume of all the particles of the catalyst for producing said more diesel; and wherein less than 5 vol. % of the catalytic cracking catalyst particles have a particle size of less than 40 μm relative to the volume of all the catalytic cracking catalyst particles; and wherein less than 10 vol. % of the catalytic cracking catalyst particles have a particle size of greater than 80 μm relative to the volume of all the catalytic cracking catalyst particles.

49. The process according to claim 32 wherein the initial activity is not greater than 75; the self-balancing time is from 0.2 to 30 hours; the equilibrium activity is from 40 to 55.

50. The process according to claim 33 wherein the fluidized bed is a dense phase fluidized bed; the ageing temperature is from 500 to 750° C.; the superficial linear velocity of the fluidized bed is from 0.15 to 0.5 m/s; and the ageing time is from 5 to 360 h.

51. The process according to claim 34 wherein the fluidized bed is a dense phase fluidized bed; the ageing temperature is from 500 to 750° C.; the superficial linear velocity of the fluidized bed is from 0.15 to 0.5 m/s; the water vapor/ageing medium weight ratio is from 0.40 to 0.60; and wherein the ageing time is from 5 to 360 h.

52. The process according to claim 35 wherein the fluidized bed is a dense phase fluidized bed; the ageing temperature is from 500 to 750° C.; the superficial linear velocity of the fluidized bed is from 0.15 to 0.5 m/s; the ageing time is from 5 to 360 h; and the water vapor/ageing medium weight ratio is from 0.50 to 0.15.

53. The process according to claim 38 wherein the reaction temperature is from 460 to 580° C.; the weight hourly space velocity ranges from 10-90 $h^{-1}$; and the catalyst/cracking feedstock oil weight ratio is from 1 to 14.

54. The process according to claim 40 wherein the initial boiling point is not less than 330° C.; and the hydrogen content is not less than 10.8 wt %.

* * * * *

UNITED STATES PATENT AND TRADEMARK OFFICE

CERTIFICATE OF CORRECTION

PATENT NO. : 8,529,754 B2
APPLICATION NO. : 12/888780
DATED : September 10, 2013
INVENTOR(S) : Shouye Cui et al.

It is certified that error appears in the above-identified patent and that said Letters Patent is hereby corrected as shown below:

On the title page item (73) should read:

Assignees: China Petroleum & Chemical Corporation, Beijing (CN);
Research Institute of Petroleum Processing, Sinopec, Beijing (CN)

Signed and Sealed this
Eleventh Day of March, 2014

Michelle K. Lee

Michelle K. Lee
*Deputy Director of the United States Patent and Trademark Office*